US010184420B2

(12) United States Patent
Tempesta et al.

(10) Patent No.: US 10,184,420 B2
(45) Date of Patent: Jan. 22, 2019

(54) WATER JACKET FOR AN INTERNAL COMBUSTION ENGINE

(71) Applicant: GM GLOBAL TECHNOLOGY OPERATIONS LLC, Detroit, MI (US)

(72) Inventors: Michele Tempesta, La Loggia (IT); Alfonso Renella, Beinasco (IT); Paolo Lavazza, Turin (IT); Andrea Palma, Giaveno (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 125 days.

(21) Appl. No.: 15/059,643

(22) Filed: Mar. 3, 2016

(65) Prior Publication Data

US 2016/0258381 A1 Sep. 8, 2016

(30) Foreign Application Priority Data

Mar. 4, 2015 (GB) ..... 1503699.9

(51) Int. Cl.

| | |
|---|---|
| ***F02F 1/10*** | (2006.01) |
| ***F02F 1/40*** | (2006.01) |
| ***F02F 1/14*** | (2006.01) |
| *F02F 1/24* | (2006.01) |

(52) U.S. Cl.

CPC ..... *F02F 1/40* (2013.01); *F02F 1/14* (2013.01); *F02F 1/243* (2013.01); *F02F 2001/104* (2013.01)

(58) Field of Classification Search

CPC .. F01P 3/02; F01P 2003/027; F01P 2003/021; F01P 3/14; F02F 1/40; F02F 1/14; F02F 1/10; F02F 1/36; F02F 2001/104; F02F 1/166

USPC ..... 123/41.01, 41.72, 41.74, 41.82 R

See application file for complete search history.

(56) References Cited

U.S. PATENT DOCUMENTS

| | | | | |
|---|---|---|---|---|
| 3,818,878 A * | 6/1974 | Zaruba | F02F 1/40 | 123/41.73 |
| 6,871,699 B1 * | 3/2005 | Boyd | F01P 3/12 | 123/41.31 |
| 2002/0124815 A1 * | 9/2002 | Ishiguro | F02F 1/242 | 123/41.82 R |

(Continued)

FOREIGN PATENT DOCUMENTS

| | | | |
|---|---|---|---|
| AT | 414022 B * | 8/2006 | F02F 1/36 |
| CN | 103388536 A | 11/2013 | |

(Continued)

OTHER PUBLICATIONS

Great Britain Patent Office, Great Britain Search Report for Great Britain Application No. 1503699.9, dated Aug. 11, 2015.

*Primary Examiner* — Marguerite McMahon
*Assistant Examiner* — Tea Holbrook
(74) *Attorney, Agent, or Firm* — Lorenz & Kopf, LLP

(57) ABSTRACT

A water jacket having a coolant flow crossing the space over the cylinder head is provided for an internal combustion engine of an automotive system. The internal combustion engine is equipped with a cylinder and a cylinder head. The water jacket includes a lower water jacket having side passages surrounding the cylinder and connected together by a plurality of branches disposed over the cylinder head, so as to create the coolant flow crossing the space over the cylinder head.

9 Claims, 6 Drawing Sheets

(56) References Cited

U.S. PATENT DOCUMENTS

2009/0000578 A1* 1/2009 Reustle ..... B22D 15/02 123/41.82 R
2009/0126659 A1* 5/2009 Lester ..... F01N 3/046 123/41.72
2010/0089343 A1* 4/2010 Hamada ..... F01P 3/02 123/41.74
2010/0242869 A1 9/2010 Knollmayr
2011/0277723 A1* 11/2011 Galeazzi ..... F02F 1/243 123/193.5
2011/0315098 A1 12/2011 Kosugi et al.
2011/0315129 A1* 12/2011 Kojima ..... F02F 1/243 123/568.12
2012/0012073 A1* 1/2012 Brewer ..... F01N 13/105 123/41.74
2012/0090566 A1* 4/2012 Knollmayr ..... F02F 1/40 123/41.82 R
2012/0227686 A1* 9/2012 D'Anna ..... F02F 1/243 123/41.82 R
2014/0202143 A1 7/2014 Tabuchi
2015/0292389 A1* 10/2015 Clark ..... F01P 3/02 123/193.5
2015/0308754 A1* 10/2015 Gautier ..... F01P 11/04 165/177
2015/0369167 A1* 12/2015 Beyer ..... F02F 1/16 123/41.74
2016/0061149 A1* 3/2016 Moran ..... F02F 1/243 123/568.13
2016/0186641 A1* 6/2016 Ogino ..... F01P 3/02 123/41.74

FOREIGN PATENT DOCUMENTS

DE 1961322 A1 * 6/1971 ..... F01P 3/02
DE 3123538 A1 * 3/1982 ..... F02F 1/36
EP 0206125 A2 * 12/1986 ..... F01P 3/02
GB 2469825 A 11/2010
JP 2000213346 A 8/2000
JP 2003035197 A * 2/2003 ..... F02F 1/40
WO 9609467 A1 3/1996

* cited by examiner

WATER JACKET FOR AN INTERNAL COMBUSTION ENGINE

CROSS-REFERENCE TO RELATED APPLICATION

This application claims priority to Great Britain Patent Application No. 1503699.9, filed Mar. 4, 2015, which is incorporated herein by reference in its entirety.

TECHNICAL FIELD

The present disclosure pertains to a water jacket for an internal combustion engine.

BACKGROUND

It is known that internal combustion engines are equipped with a cooling system. The cooling system is generally provided for cooling down the internal combustion engine, as well as other engine fluids, such as for example the exhaust gas in the EGR cooler and/or the lubricating oil in the oil cooler.

The cooling system schematically includes a coolant pump that delivers a coolant fluid, typically a mixture of water and antifreeze, from a coolant tank to a plurality of cooling channels internally defined by the engine block and the cylinder head and forming a so-called cylinder water jacket.

Once the coolant is circulated through a cylinder water jacket, it may be diverted to another portion of the internal combustion engine, namely the cylinder head, to remove additional excess heat or it may be pumped to a heat exchanger where heat is removed from the coolant prior to being returned to the engine.

In a known embodiment, a cylinder block of an internal combustion engine has an inner side wall defining the cylinder bores and an outer side wall surrounding the inner side wall. A cylinder block water jacket is defined by the inner side wall and the outer side wall. A cooling water inlet is formed in one end of the cylinder block. Cooling water flows through the cooling water inlet into the cylinder block water jacket. The cooling water supplied through the cooling water inlet into the cylinder block water jacket is divided into two cooling water streams, one for each side of the cylinder block, by means of two side passages through which the cooling water flows in a longitudinal direction from the cooling water inlet to a cooling water outlet.

Known water jackets for internal combustion engines leave open a series of issues. A first issue is that the coolant flows in the engine block on both sides of the cylinder head, namely the intake and exhaust side, leading to difficulties in managing and calibrating both coolant flows in the deck cooling area, in order to have good balancing among cylinders. Furthermore, known water jackets are penalized by a high pressure drop and need a significant volume of coolant to operate properly. Finally, known water jackets may be costly to produce due to casting and manufacturing difficulties.

SUMMARY

In accordance with the present disclosure a water jacket for an internal combustion engine having a calibrated coolant flow and improved efficiency of the flow without using external devices and an internal combustion engine in which all its main features are integrated in the same head casting.

An embodiment of the disclosure provides a water jacket for an internal combustion engine of an automotive system, the internal combustion engine being equipped with a cylinder and a cylinder head. The water jacket includes a lower water jacket having side passages surrounding the cylinder. The side passages are connected together by a plurality of branches disposed over the cylinder head, so as to create a coolant flow crossing the space over the cylinder head. An advantage of this embodiment is that it transforms the longitudinal flow of the coolant fluid into a cross flow coolant fluid over the cylinder head and at the same time allows calibration of the coolant flow and improvement of the efficiency of coolant flow.

According to another embodiment of the present disclosure, the side passages are connected together, in their closest mutual position, by a couple of connecting branches. An advantage of this embodiment is that it allows to create part of the cross flow of the coolant fluid over the cylinder head. According to another embodiment of the present disclosure, the branches connecting together the side passages include, for each cylinder, a longitudinal branch positioned over the cylinder head and crossing a part of the a middle portion thereof. An advantage of this embodiment is that it forms part of a structure allowing cross flow of the coolant fluid over the cylinder head.

According to still another embodiment of the present disclosure, each longitudinal branch is connected to the connecting branches by middle branches positioned over the cylinder head and crossing a part thereof. An advantage of this embodiment is that it completes a structure allowing cross flow of the coolant fluid over the cylinder head.

According to still another embodiment of the present disclosure, the lower water jacket includes dedicated channels for the coolant to reach components of the automotive system to be cooled, each dedicated channel stemming from one of the side passages and being configured to reach a specific component. An advantage of this embodiment is that is cools only the components of interest of the automotive system and, at the same time, calibrates the sectional areas of the dedicated channel in order to optimize the coolant flow.

According to another embodiment of the present disclosure, the lower water jacket is in fluid communication with an upper water jacket by means of passages, which derive the coolant from ports in the side passages of the lower water jacket. An advantage of this embodiment is that the coolant fluid flows from the lower water jacket to the upper water jacket and, at the same time, permits inspection of the connection between lower and upper portions of the water jacket.

According to another embodiment of the present disclosure, the lower water jacket is in fluid communication with the upper water jacket by inclined branches that are connected to the connecting branches. An advantage of this embodiment is that the structure allows the flow of the coolant fluid from the lower water jacket to the upper water jacket.

According to another embodiment of the present disclosure, the upper water jacket includes dedicated channels for the coolant to reach a specific component of the automotive system to be cooled. An advantage of this embodiment is that it cools only the components of interest of the automotive system from above.

According to another embodiment of the present disclosure, the upper water jacket is superimposed to the lower water jacket in such a way to create a cage structure for an exhaust manifold of the internal combustion engine, the cage structure including the dedicated channels of the lower water jacket and the dedicated channels of the upper water jacket. An advantage of this embodiment is that it allows to calibrate the integrated exhaust manifold cooling circuit independently from the deck cooling.

According to a further embodiment of the present disclosure, the upper water jacket and the lower water jacket are in fluid communication with a ring which is proximal to a coolant outlet of the water jacket.

Another embodiment of the present disclosure includes an automotive system including a water jacket for an internal combustion engine. The components of the automotive system to be cooled by the coolant fluid flowing in the water jacket are a turbine flange, an EGR valve element and an EGR valve flange.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
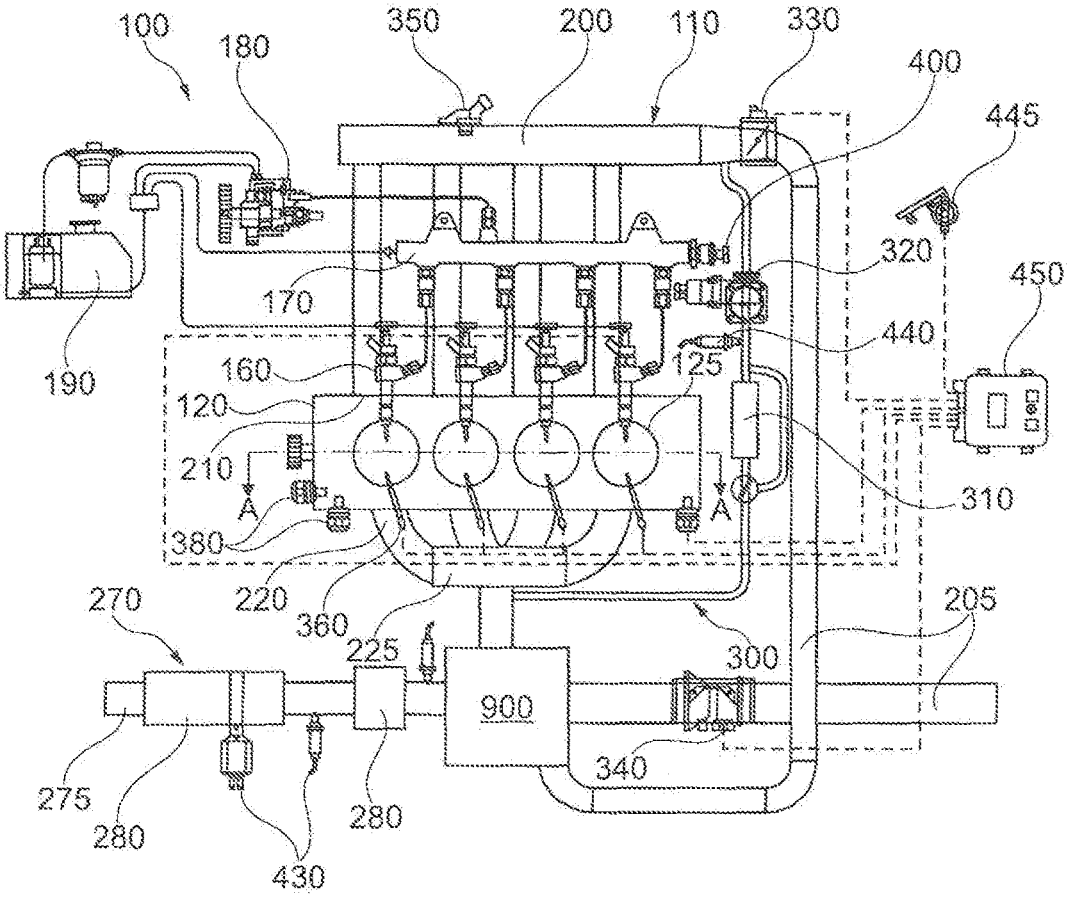
FIG. 1 shows an automotive system.
Figure 2:
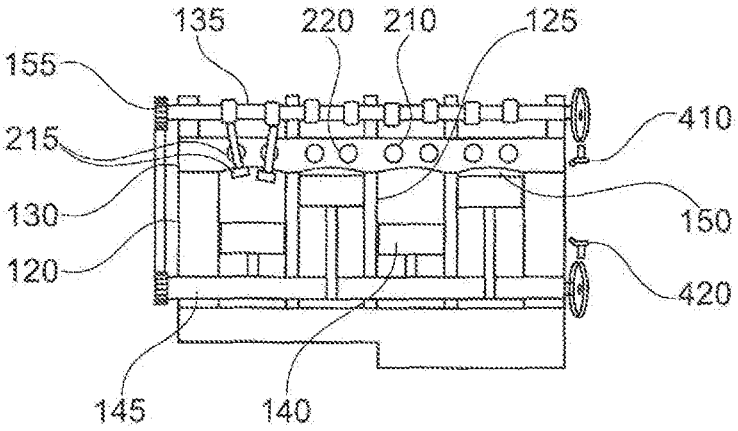
FIG. 2 is a cross-section of an internal combustion engine belonging to the automotive system of FIG. 1.

Some embodiments may include an automotive system 100, as shown in FIGS. 1 and 2 including an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increases the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200.

In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust gases of the engine are directed into an exhaust system 270. The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean $NO_x$ traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110 and with a memory system, or data carrier, and an interface bus. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, a Variable Geometry Turbine (VGT) actuator 290, and the cam phaser 155. Note, dashed lines are used to indicate communication between the ECU 450 and the various sensors and devices, but some are omitted for clarity.

Figure 3:
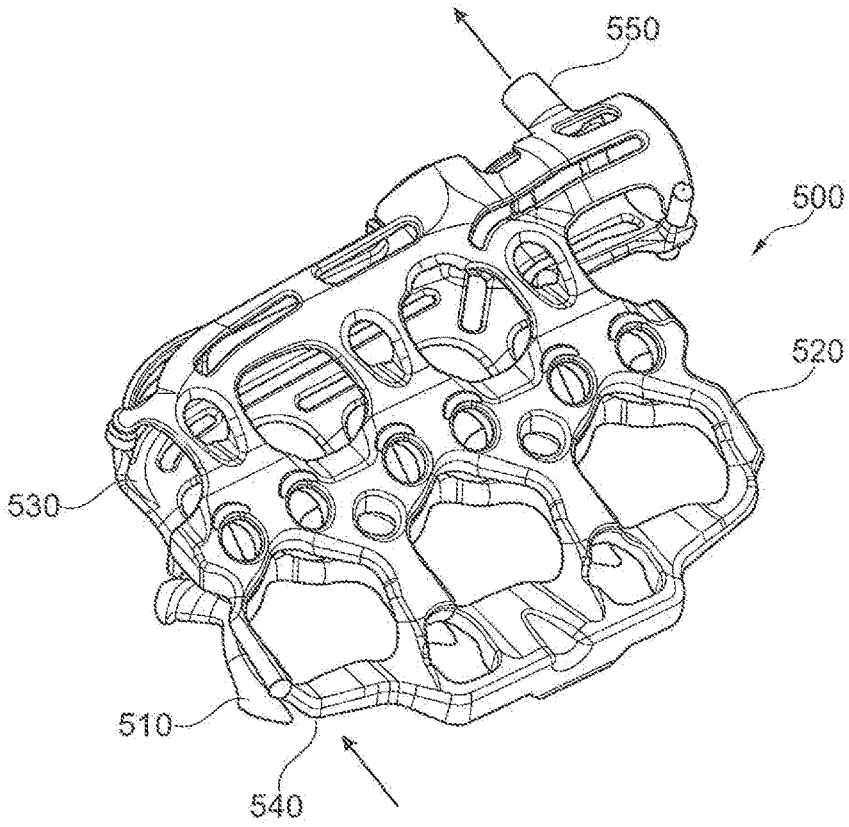
FIG. 3 is an axonometric view of a water jacket for an internal combustion engine, according to an embodiment of the present disclosure.

Referring now to FIG. 3, a water jacket 500 for the internal combustion engine 110, according to an embodiment of the present disclosure, is represented as applied to a three cylinders engine. The water jacket 500 is subdivided in a lower water jacket 510 and an upper water jacket 520, the lower water jacket 510 being positioned on top of the cylinder head 130 and the upper water jacket 520 being positioned on top of the lower water jacket 510. The upper water jacket 520 is superimposed onto the lower water jacket 510 in such a way to create a cage structure 530 for the exhaust manifold 225 (not represented in FIG. 3 for simplicity) of the internal combustion engine 110.

The coolant, typically a mixture of water and antifreeze, enters into the cylinder block (not represented in FIG. 3 for simplicity) through coolant inlet 540 and, after circulation through the lower water jacket 510 and the upper water jacket 520, exits through coolant outlet 550 in correspondence of EGR valve 320.

Figure 4:
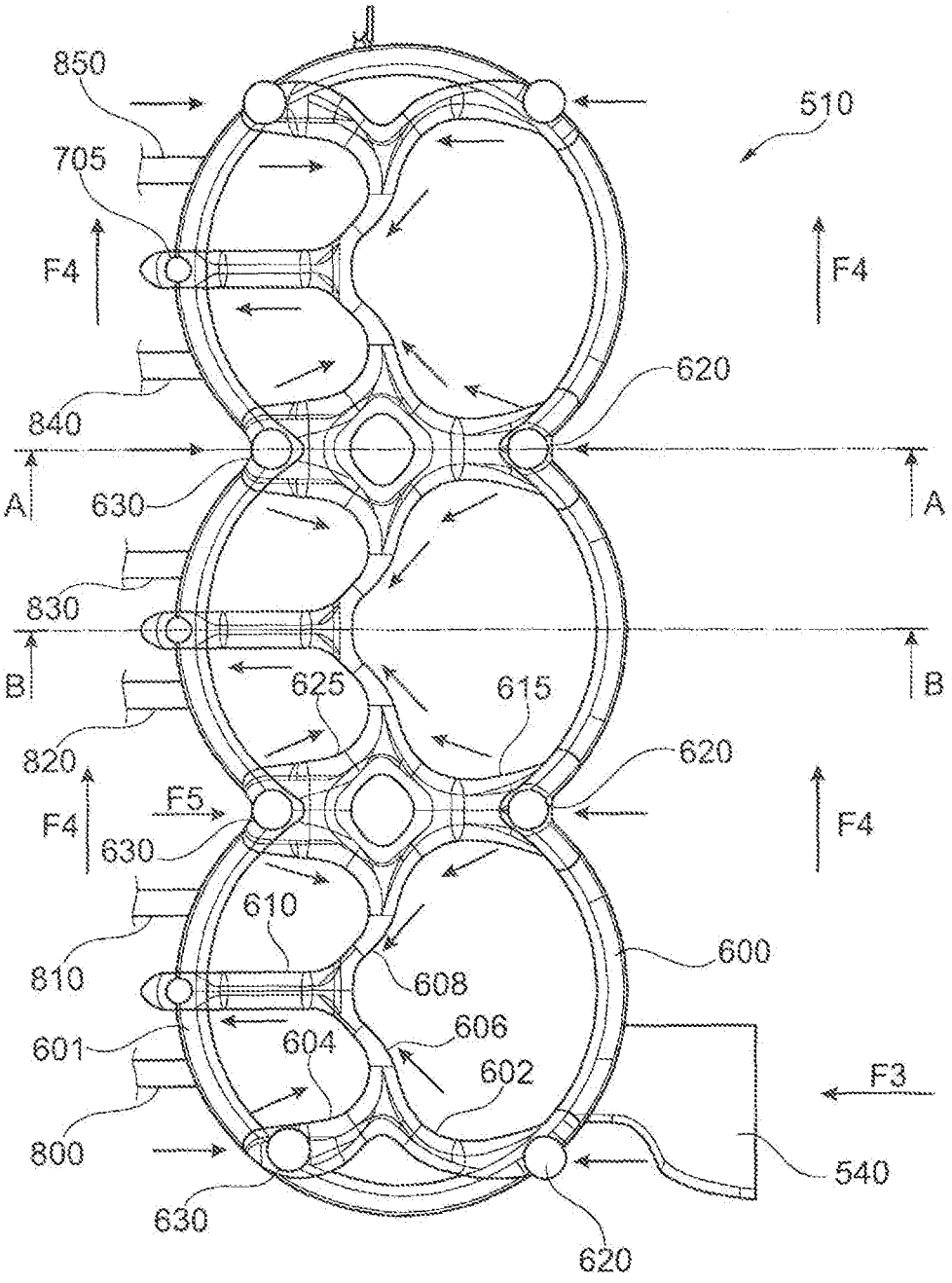
FIG. 4 is a top view of the lower water jacket of FIG. 3.
Figure 6:
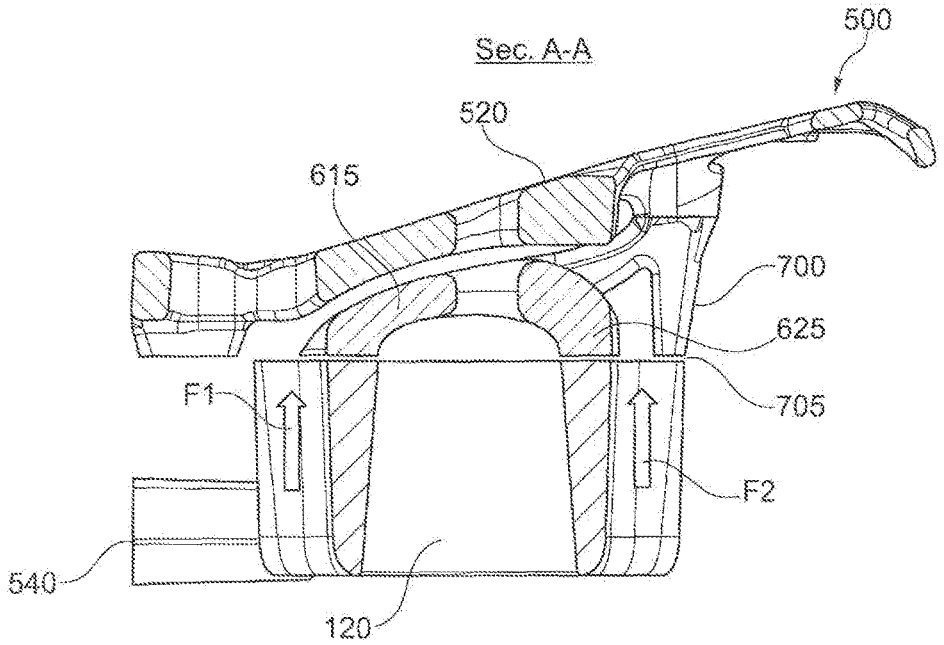
FIG. 6 is a section according to plane A-A of FIG. 4.

In FIG. 4, a top view of the lower water jacket 510 is represented. The lower water jacket 510 surrounds the cylinder block 120 and has a portion which is subdivided in two side passages 600, 601, one for each side of the cylinder block 120, whereby side passages 600, 601 substantially follow the external shape of the cylinders 125. The coolant entering the cylinder block 120 from inlet 540 follows the path represented with arrows F1 and F2 in FIG. 6 and reaches outlets 620 and 630 in the lower water jacket 510 from which the coolant respectively flows through side passages 600, 601.

The lower water jacket 510 also includes, between each cylinder 125, connecting branches 615 and 625 that connects together side passage 600 with side passage 601, preferably joining them in their closest mutual position. Furthermore, the lower water jacket 510 also includes, for each cylinder 125, a longitudinal branch 610 which is disposed over the cylinder head 130 and is connected, on one side to side passage 601 and to the other side to middle branches 606 and 608, each middle branch 606 and 608 stemming either from connecting branches 615 and 625 or from a couple of side branches 602 and 604. More specifically, the water jacket 500 include, for each cylinder 125, a longitudinal branch 610 positioned over the cylinder head 130 and crossing a part of the middle portion thereof. Moreover, each longitudinal branch 610 is connected to the connecting branches 615, 625 by means of the middle branches 606, 608 positioned over the cylinder head 130 and crossing a part thereof.

The above described configuration has the effect of creating a structure suitable for transforming a longitudinal flow of the coolant on both sides of the cylinder block into a cross flow of the coolant over the cylinder head 130, which allows calibrated coolant fluid flow and improved efficiency of coolant flow without using external devices. More specifically, calibration of the diameters and shapes of the various described branches allows to optimize the coolant flow velocity in the various areas of the water jacket.

Figure 5:
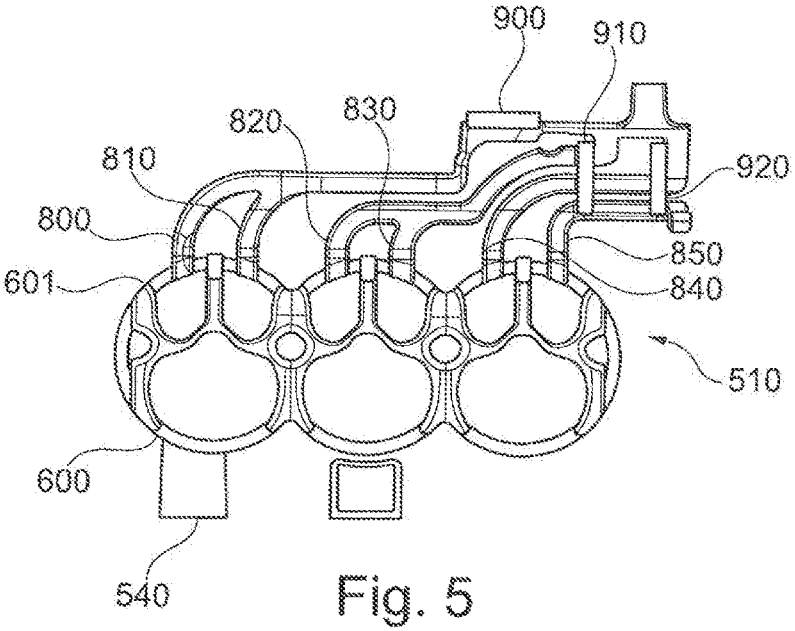
FIG. 5 is a top view of the lower water jacket of FIG. 3, provided with outlet channels.

FIG. 5 is a top view of the lower water jacket 510 of FIG. 3. The lower water jacket 510 is represented as provided with outlet channels. More specifically, the lower water jacket 510 is provided, in correspondence with each cylinder 125, with two channels each, and each channel having a calibrated section to optimize the balance of the coolant flow. In particular, a first couple of channels 800, 810 runs from side passage 601 towards an area where a flange 900 for the turbine 250 is positioned.

A second couple of channels 820, 830 runs from side passage 601 towards an area where an EGR valve element 910 is positioned and a third couple of channels 840, 850 runs from side passage 601 towards an area where an EGR valve flange 920 is positioned. Each couple of channels may converge in a single duct before reaching the respective element to be cooled. Furthermore, this configuration allows to cool only the elements in the critical areas including the turbine flange 900, the EGR valve element 910 and the EGR valve flange 920.

Figure 7:
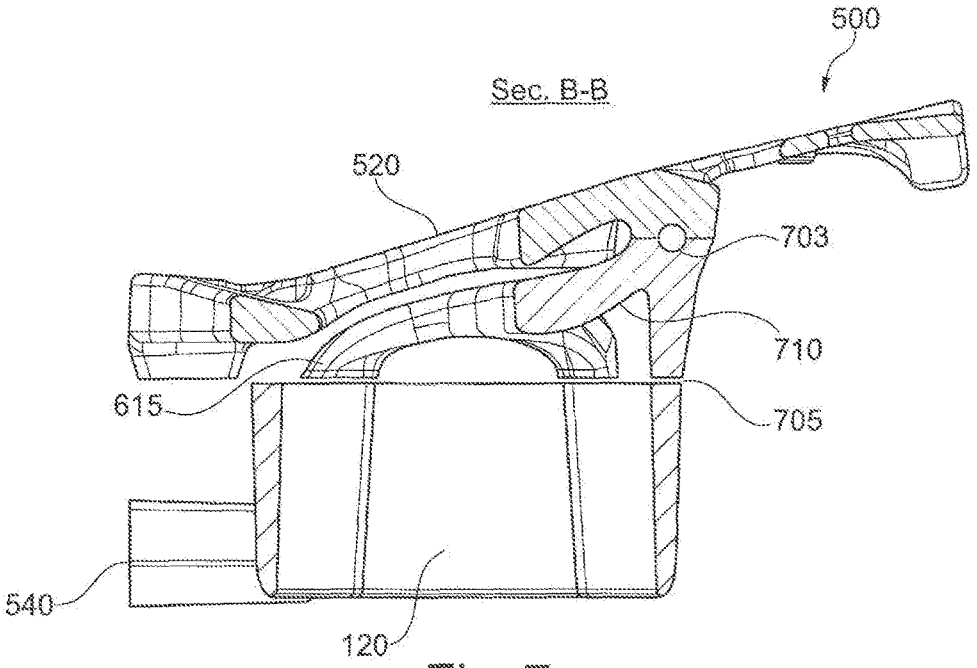
FIG. 7 is a section according to plane B-B of FIG. 4.

Referring now to FIG. 7, a further embodiment of the present disclosure is disclosed, wherein the lower water jacket 510 and the upper water jacket 520 are connected by means of passages 700 which derive the coolant from ports 705 in the lower water jacket 510. The ports 705 are disposed in the side passages 600, 601 in their closest mutual position. Furthermore, the lower water jacket 510 is connected to the upper water jacket 520 by means of inclined branches 710 that are connected to connecting branches 615 and 625. The particular shape of passages 700 allows for easy inspection of the connection between lower and upper water jackets 510 ad 520 in inspection point 703.

Figure 8:
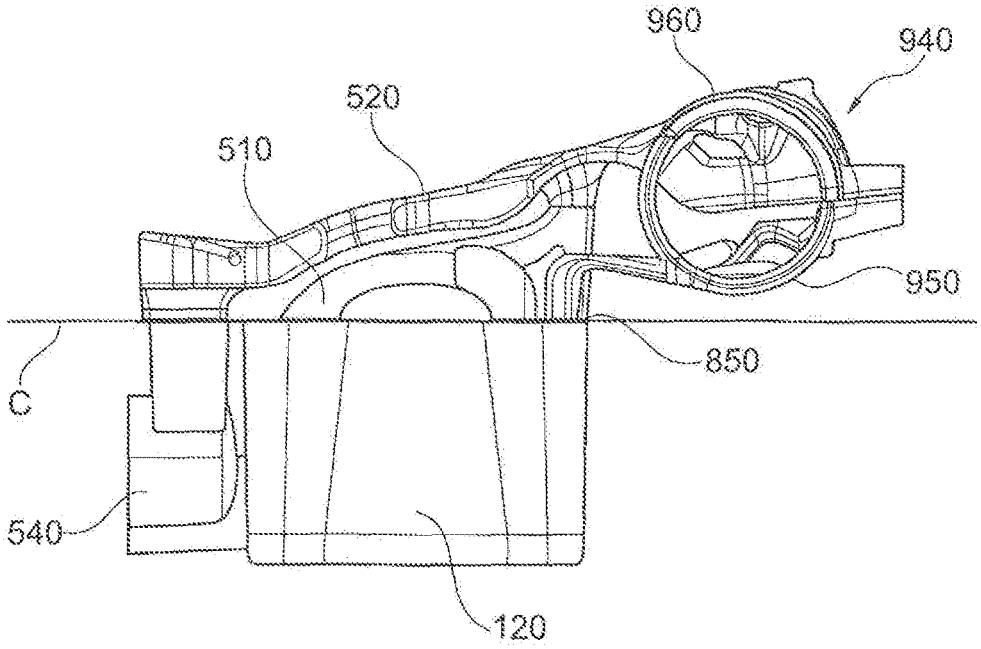
FIG. 8 is a side view of the water jacket of FIG. 3.

FIG. 8 is a side view of the water jacket of FIG. 3 where a particular shape of the combination of the lower water jacket 510 and of the upper water jacket 520 can be seen. In FIG. 8, straight line C defines the separation between the cylinder block 120 and the deck, namely the upper portion of the engine 110. In this configuration, a ring 940 is formed in an area of connection of the lower water jacket 510 with the upper water jacket 520, the ring 940 being formed by a lower portion 950, belonging to the lower water jacket 510, and by an upper portion 960 belonging to the upper water jacket 520.

As a result, the lower jacket is dedicated to deck cooling only, allowing for better cooling capability for the most critical area. On the other hand, this configuration allows for dedicated cooling for the integrated exhaust manifold 225 and leaves open the possibility to add a control valve at the outlet. Furthermore the lower portion 950 and the upper portion 960 of the ring 940 form dedicated channels around the exhaust manifold for its cooling and do not affect deck cooling.

Figure 9:
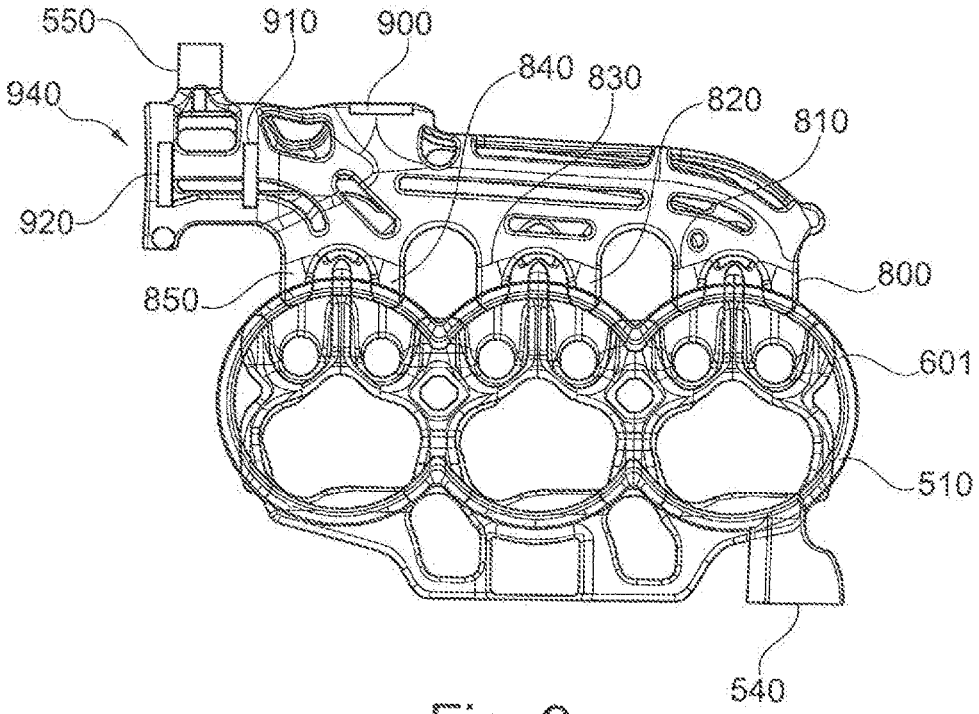
FIG. 9 is a bottom view of the water jacket of FIG. 3.
Figure 10:
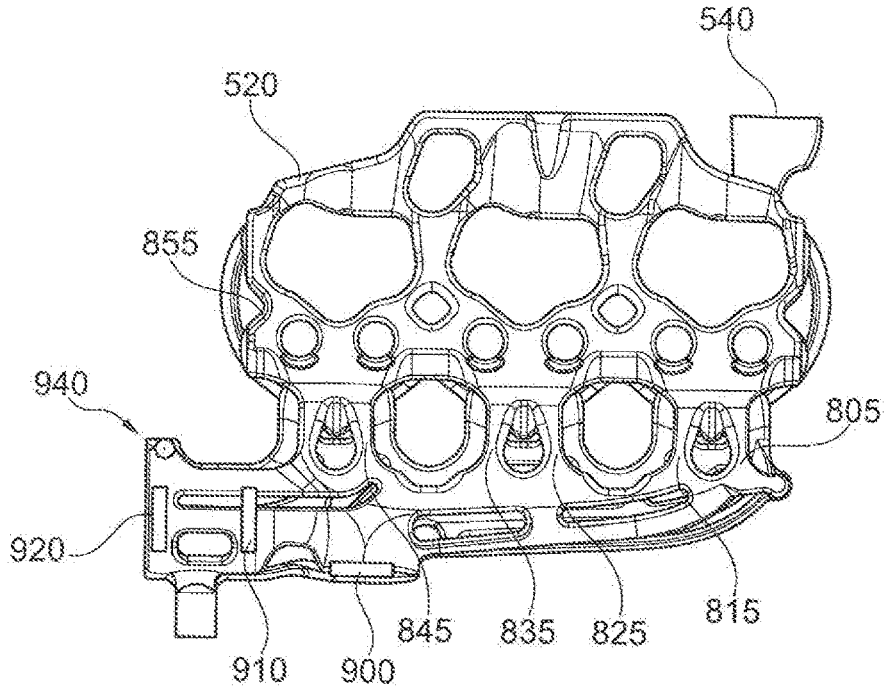
FIG. 10 is a top view of the water jacket of FIG. 3.

In FIG. 9 a bottom view of the water jacket 500 is represented showing the couple of channels 800, 810, 820, 830 and 840, 850. In FIG. 10 is shown a top view of the water jacket of FIG. 3 where corresponding couple of channels 805, 815, 825, 835 and 845, 855 are shown.

In operation, the coolant is circulated inside the water jacket 500 by means of a pump (not represented) and enters into the cylinder block 120. As mentioned above, the coolant entering the cylinder block 120 from inlet 540 (arrow F3 in FIG. 4) follows the path represented with arrows F1 and F2 in FIG. 6 and reaches outlets 620 and 630 in the lower water jacket 510 from which the coolant respectively flow through side passages 600, 601 following a longitudinal flow as represented by arrows F4.

However, once the coolants exits from outlets 620 and 630, the longitudinal flow is transformed into a coolant flow crossing the space over the cylinder head 130 (horizontal arrows F5 of FIG. 4). Following the small arrows of FIG. 5, the coolant flows through connecting branches 615 and 625 that connects side passage 600 with side passage 601, through middle branches 606 and 608 and side branches 602 and 604 and, finally, through longitudinal branches 610 and then exits the portion of the lower water jacket 510 surrounding the cylinders 125.

In particular, a portion of the coolant flow exits through the couple of channels 800, 810 that flow toward the turbine flange 900, through the second couple of channels 820, 830 towards the position of the EGR valve element 910 and through a third couple of channels 840, 850 towards the EGR valve flange 920.

A second portion of the coolant flow reaches the upper water jacket 520 by exiting through ports 705 and following passage 700, while a third portion of the coolant flow fluid exiting from outlets 620 and 630 and passing through connecting branches 615, 625 flows through inclined branch 710 to reach the upper water jacket 520. The second and third portions of the coolant flow that have reached the upper water jacket 520 exit through the couple of channels 805, 815 that flow toward the turbine flange 900, through the second couple of channels 825, 835 towards the position of the EGR valve element 910 and through the third couple of channels 845, 855 towards the EGR valve flange 920. Finally both coolant flows unite in the ring 940 flowing through the lower ring portion 950 and through the upper ring portion 960 and exit the water jacket 500 through coolant outlet 550 in correspondence of EGR valve 320 to be recirculated by the pump.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A water jacket for an internal combustion engine of an automotive system, the internal combustion engine having a cylinder and a cylinder head, the water jacket comprising:

a lower water jacket having side passages surrounding the cylinder and being connected together by a plurality of crossing branches disposed over the cylinder head, wherein, for each cylinder, the crossing branch connecting together with the side passages comprises a longitudinal branch positioned over and crossing a first portion of the cylinder head and a middle branch positioned over and crossing a second portion of the cylinder head such that a coolant flow crosses the space over the cylinder head;

an upper water jacket superimposed over ports in the side passages of the lower water jacket to provide fluid communication therebetween; and a cage structure including a plurality of cooling channels laterally offset from and in fluid communication with the side passages, wherein the plurality of cooling channels are configured to encompass an exhaust manifold of the internal combustion engine.

2. The water jacket according to claim 1, wherein the side passages are connected together in their closest mutual position with at least one of the plurality of crossing branches.

3. An automotive system comprising a water jacket for an internal combustion engine according to claim 2, wherein the components of the automotive system to be cooled by the coolant fluid flowing in the water jacket includes at least one of a turbine flange, an EGR valve element and an EGR valve flange.

4. The water jacket according to claim 1, wherein the lower water jacket comprises dedicated channels for the coolant to reach components of the automotive system to be cooled, each dedicated channel stemming from one of the side passages and configured to reach a first component.

5. The water jacket according to claim 4, wherein the lower water jacket is in fluid communication with the upper water jacket with inclined branches that are connected to the crossing branches.

6. The water jacket according to claim 5, wherein the upper water jacket comprises dedicated channels for the coolant to reach a specific component of the automotive system to be cooled.

7. The water jacket according to claim 6, wherein the upper water jacket is superimposed to the lower water jacket in such a way to create the cage structure for encompassing the exhaust manifold of the internal combustion engine, wherein the cage structure includes the dedicated channels of the lower water jacket and the dedicated channels of the upper water jacket.

8. The water jacket according to claim 7, wherein the upper water jacket and the lower water jacket are in fluid communication with a ring which is proximal to a coolant outlet of the water jacket.

9. The water jacket according to claim 4, wherein the cage structure comprises a flange configured to support a component of the internal combustion engine such that the flange is in thermal communication with the component.

* * * * *